US005784790A

United States Patent [19]

Carson, III et al.

[11] Patent Number: 5,784,790

[45] Date of Patent: Jul. 28, 1998

[54] SHAVING RAZOR AND METHOD

[75] Inventors: William C. Carson, III, Acton; Alejandro C. Lee, Cambridge; Stephen C. Metcalf, West Newton; Paul Nowak, Danvers; Robert A. Trotta, Pembroke; Charles B. Worrick, Hanson, all of Mass.

[73] Assignee: The Gillette Company, Boston, Mass.

[21] Appl. No.: 802,814

[22] Filed: Feb. 19, 1997

Related U.S. Application Data

[63] Continuation-in-part of Ser. No. 630,437, Apr. 10, 1996.

[51] Int. Cl.[6] ..... B26B 21/52

[52] U.S. Cl. ..... 30/532; 30/527

[58] Field of Search ..... 30/526, 532, 527, 30/530, 531, 47, 50

[56] References Cited

U.S. PATENT DOCUMENTS

| | | | |
|---|---|---|---|
| 2,694,856 | 11/1954 | Muros et al. | 30/32 |
| 3,363,312 | 1/1968 | Fayed | 30/40.1 |
| 3,740,841 | 6/1973 | Risher | 30/32 |
| 3,795,979 | 3/1974 | Perry | 30/526 |
| 4,266,340 | 5/1981 | Bowman | 30/532 |
| 4,446,619 | 5/1984 | Jacobson | 30/526 |
| 4,514,904 | 5/1985 | Bond | 30/47 |
| 5,016,352 | 5/1991 | Metcalf | 30/532 |
| 5,027,511 | 7/1991 | Miller | 30/526 |
| 5,331,740 | 7/1994 | Carson, III et al. | 30/526 |
| 5,347,717 | 9/1994 | Ts'ai | 30/532 |
| 5,497,551 | 3/1996 | Apprille | 30/526 |

*Primary Examiner*—Hwei-siu Payer
*Attorney, Agent, or Firm*—Fish & Richardson P.C.

[57] ABSTRACT

A cartridge-connecting subassembly for a shaving razor handle including a cartridge connecting structure, a handle connecting structure, and a movable component within the cartridge connecting structure that interacts with a replaceable cartridge when it is connected. The cartridge connecting structure and handle connecting structure have outer side surfaces that mate with inwardly directed surfaces of the cartridge and handle so that the subassembly is substantially covered when it is mounted in the handle and a cartridge is connected. The subassembly has an assembly opening for receiving the movable component during assembly, a cartridge interaction opening through which the component is movable for interaction with the cartridge, and blocking structure that retains the movable component in the subassembly. The movable component is an ejector structure that is separate from the cartridge connecting structure. The subassembly is connected to the handle by staking. The handle has gripping pads with an elastomeric outer layer and a nonelastomeric support layer thereunder.

41 Claims, 8 Drawing Sheets

SHAVING RAZOR AND METHOD

This application is a continuation-in-part of U.S. Ser. No. 08/630.437, filed Apr. 10, 1996, entitled "SHAVING SYSTEM AND METHOD."

BACKGROUND OF THE INVENTION

The invention relates to shaving razors having handles and replaceable cartridges.

Shaving systems often consist of a handle and a replaceable cartridge in which one or more blades are mounted in a plastic housing. After the blades in a cartridge have become dull from use, the cartridge is discarded, and replaced on the handle with a new cartridge. In some shaving systems the blades are resiliently mounted with respect to the cartridge housing and deflect under the force of skin contact during shaving. In some shaving systems the connection of the cartridge to the handle provides a pivotal mounting of the cartridge with respect to the handle so that the cartridge angle adjusts to follow the contours of the surface being shaved. In such systems, the cartridge can be biased toward an at rest position by the action of a spring-biased plunger (a cam follower) carried on the handle against a cam surface on the cartridge housing.

SUMMARY OF THE INVENTION

In one aspect, the invention features, in general, a cartridge-connecting subassembly for a shaving razor handle. The cartridge-connecting subassembly includes a cartridge connecting structure, a handle connecting structure, and a movable component within the cartridge connecting structure that interacts with a replaceable cartridge when it is connected. The cartridge connecting structure has outer, cartridge-supporting, side surfaces that mate with inwardly directed surfaces of a recess on the cartridge and also has cartridge holding structure that releasably holds the replaceable cartridge. The handle connecting structure has outer, handle-supporting, side surfaces that mate with inwardly directed handle surfaces of an elongated hand gripping structure of the razor handle. The cartridge connecting structure and the handle connecting structure have contiguous portions so that the subassembly is substantially covered when the handle connecting structure is connected to the elongated hand gripping structure, and the cartridge connecting structure is connected to a cartridge.

In another aspect the invention features a cartridge-connecting subassembly for a shaving razor handle that includes a housing and a movable component within the housing. The housing includes a handle connecting structure for making a permanent connection to a subassembly connecting end of an elongated hand gripping structure of the razor handle, a cartridge connecting structure for making a releasable connection to a replaceable cartridge, an assembly opening at the handle connecting structure for receiving the movable component during assembly, a cartridge interaction opening at the cartridge connecting structure through which the component is movable for interaction with the cartridge, and blocking structure that retains the movable component on the housing.

In another aspect, the invention features, in general, a cartridge-connecting subassembly for a shaving razor handle that includes a housing having handle connecting structure, a cartridge connecting structure on the housing, and an ejector structure that is separate from the cartridge connecting structure and is movably mounted on the housing with respect to the cartridge connecting structure so as to eject a cartridge from the cartridge connecting structure when moved to an ejection position.

Certain implementations of the subassembly of the invention include one or more of the following features.

In certain implementations: the movable component is a spring-biased plunger that has an end that extends from the cartridge connecting structure for biasing the cartridge; the ejector is U-shaped and has arm portions on each side of the plunger that are extendible from the cartridge connecting structure to eject a cartridge; the handle connecting structure has an opening providing access of a base portion of a button to the ejector, and the elongated hand gripping structure has a recess aligned with the opening; the handle connecting structure has a raised lip that extends above the outer, handle-supporting side surfaces; the handle connecting structure has fastener holes through the outer handle-supporting side surfaces outside of the raised lip for receiving a fastener to the elongated hand gripping structure; the handle connecting structure has side protrusions for mating with mating recesses of the inwardly directed handle surfaces; the movable member has a first cam surface and a first stop surface, and the housing has a second cam surface against which the first cam surface is deflected during insertion through the assembly opening, and the blocking structure has a second stop surface against which the first stop surface is blocked after passing the second cam surface and returning to an undeflected position, the movable member being prevented from returning through the assembly opening by interaction of the first and second stop surfaces; the blocking structure includes ribs across the interaction opening permitting passage of one part of a movable component therethrough and blocking another part of the movable component; the holding structure on the cartridge connecting structure is a depression for mating with a projection on the cartridge; alternatively, the holding structure on the cartridge connecting structure can be a projection for mating with a depression on the cartridge.

In some other aspects, the invention features, in general, shaving razor handles including cartridge connecting subassemblies as have already been described and elongated hand gripping structure.

In another aspect the invention features, in general, a shaving razor handle including an elongated hand gripping structure that has a generally straight portion and a subassembly connecting portion that is offset with respect to the straight portion and is generally flat. The handle also includes a subassembly that has a generally flat handle connecting structure permanently connected to the subassembly connecting portion, a cartridge connecting structure for making a releasable connection to a replaceable cartridge, and a movable component within the cartridge connecting structure for interacting with a replaceable cartridge.

In another aspect, the invention features, in general, a shaving razor handle including an elongated hand gripping structure, a subassembly having a cartridge connecting structure and a handle connecting structure that mates with a subassembly connecting end of the elongated hand gripping structure, and a stake that permanently connects the handle connecting structure to the subassembly connecting end.

In another aspect, the invention features, in general, a shaving razor handle including a cartridge support structure at an end of an hand gripping structure that includes a frame structure and a plurality of gripping pads. The gripping pads include an elastomeric plastic outer gripping layer and a nonelastomeric plastic support layer thereunder. The frame structure has openings that each have a restricted area leading to a larger area region within the frame structure. Each gripping pad has at least one locking tab received in a respective opening, and each locking tab has a portion that is located in the larger area region and is larger than the restricted area.

Certain implementations of the handle of the invention may include one or more of the following features.

In certain implementations: the restricted areas of the openings of the frame structure are defined by facing barbs; the gripping pads are crescent shaped with a broad area on an upper surface of the frame and two narrowing portions on two side portions; there is a locking at each narrowing portion; the broad area carries an interlocking portion that interlocks with structure on the frame; the nonelastomeric plastic support layer has a lower surface that is concave between the locking tabs; the frame has respective recessed areas in an outer surface; the gripping pads are located in the recessed areas.

In another aspect, the invention features, in general, making cartridge connecting subassemblies by inserting components into housings having cartridge connecting structures and handle connecting structures as have already been described.

In another aspect, the invention features, in general, making razor handles by securing cartridge connecting subassemblies to elongated hand gripping structures as have already been described.

Other advantages and features of the invention will be apparent from the detailed description of preferred embodiments thereof and from the claims.

DESCRIPTION OF THE PREFERRED EMBODIMENTS

Figure 1:
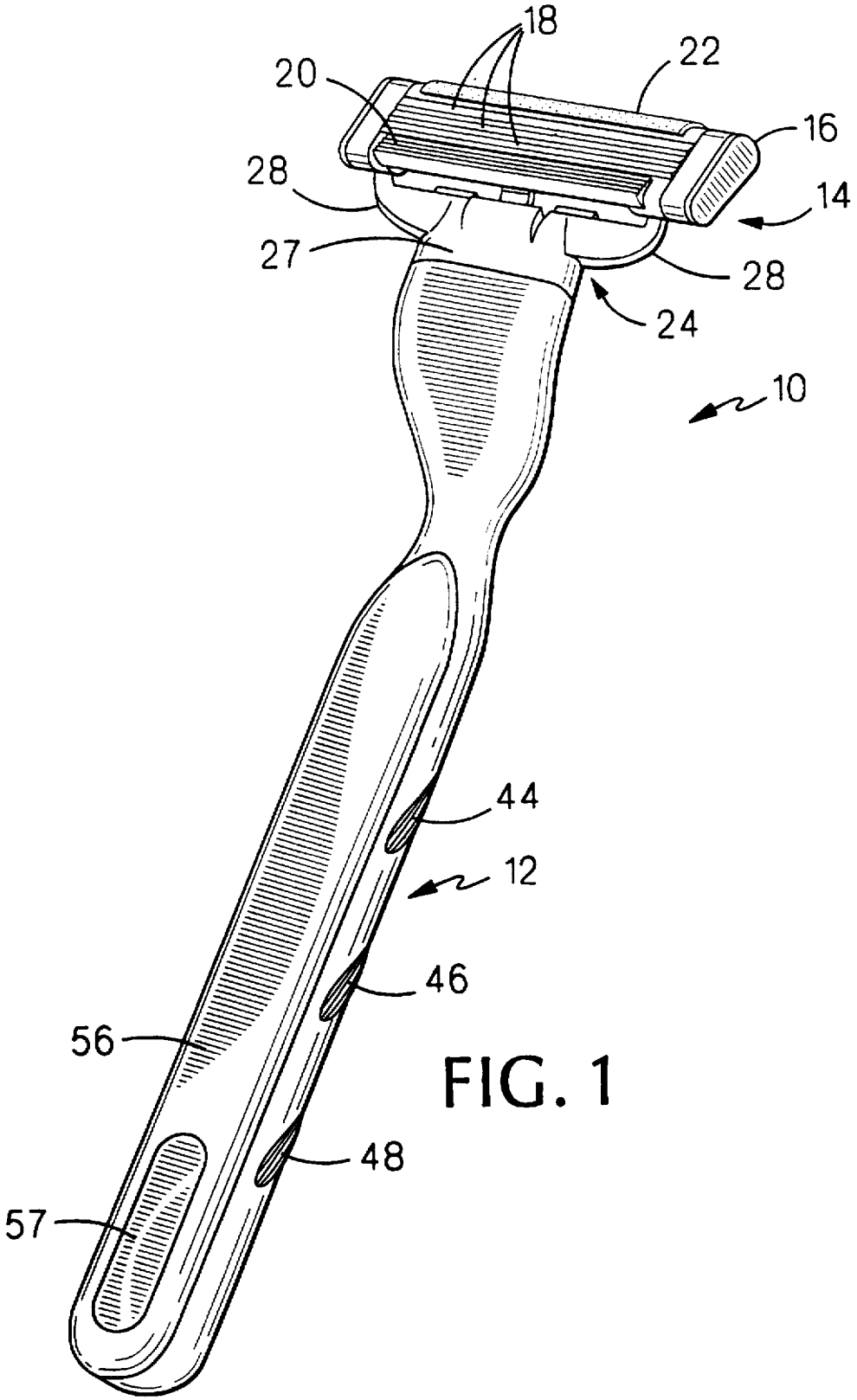
FIG. 1 is a perspective view of a shaving razor according to the invention.
Figure 2:
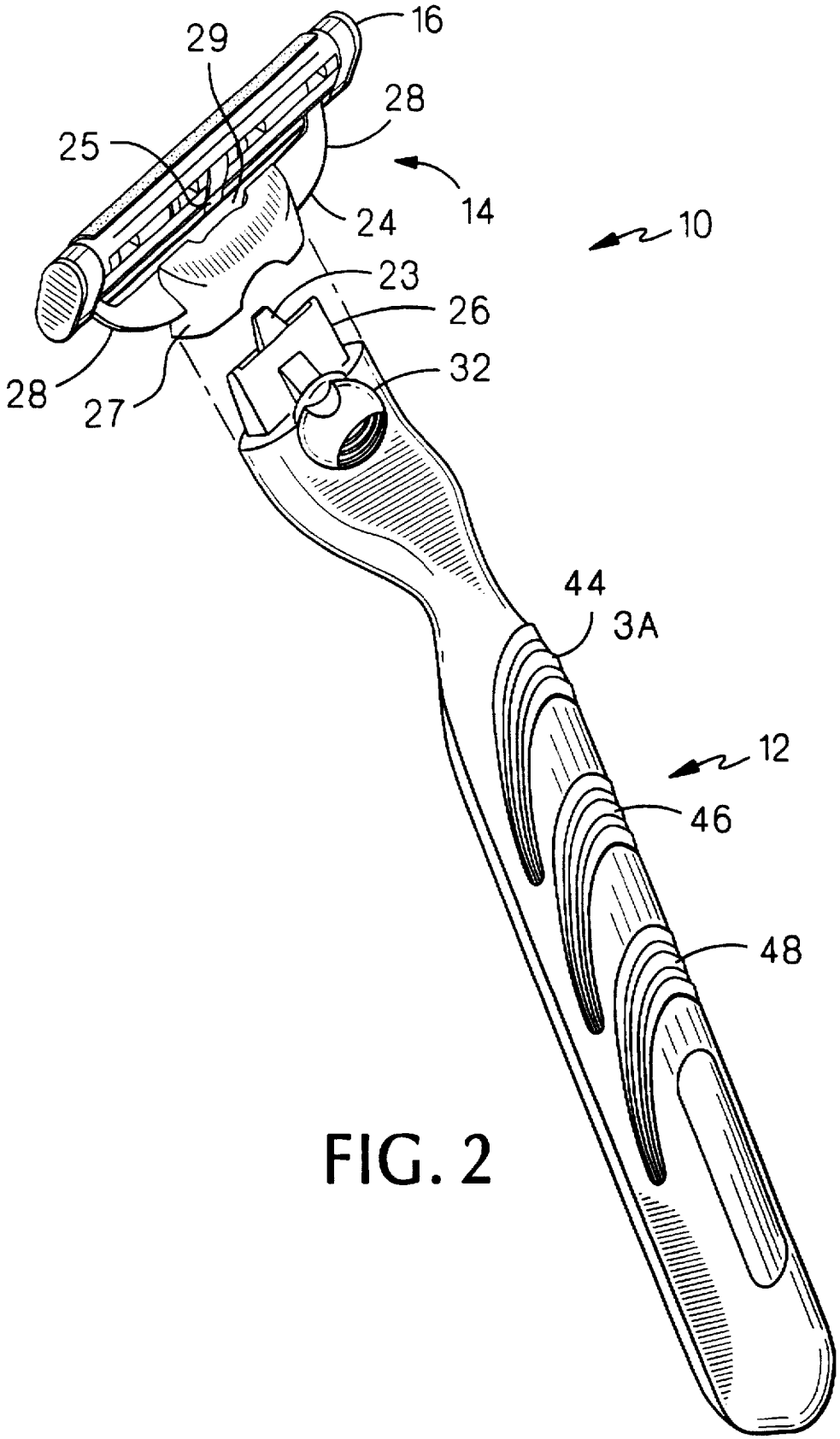
FIG. 2 is a perspective view showing a handle and a replaceable cartridge of the FIG. 1 razor separated from each other.

Referring to FIGS. 1 and 2, shaving razor 10 includes handle 12 and replaceable shaving cartridge 14. As shown in FIG. 2, cartridge 14 is removable from handle 12. Cartridge 14 includes housing 16, which carries three blades 18, guard 20 and cap 22. Cartridge 14 also includes interconnect member 24 on which housing 16 is pivotally mounted. Interconnect member 24 includes base 27, which removably and fixedly attaches to cartridge connecting structure 26 of handle 12, and two arms 28 that pivotally support housing 16 at its two sides. Housing 16 has cam surface 25 (FIG. 2) which is acted upon by spring-biased plunger 23 of handle 12; when base 27 is connected to handle 12, plunger 23 passes through opening 29 in base 27 to bias housing 16 to the forward, at rest position shown in FIG. 1. The construction and operation of shaving cartridge 14 is discussed in detail in U.S. Ser. No. 08/630,437, filed Apr. 10, 1996, which is hereby incorporated by reference as if fully set forth in its entirety herein. Handle 12 carries button 32 used to eject a cartridge 14 by activating U-shaped ejector 86 (FIG. 9), causing it to extend from the front of cartridge connecting structure 26 and push base 27 from structure 26.

Figure 3:
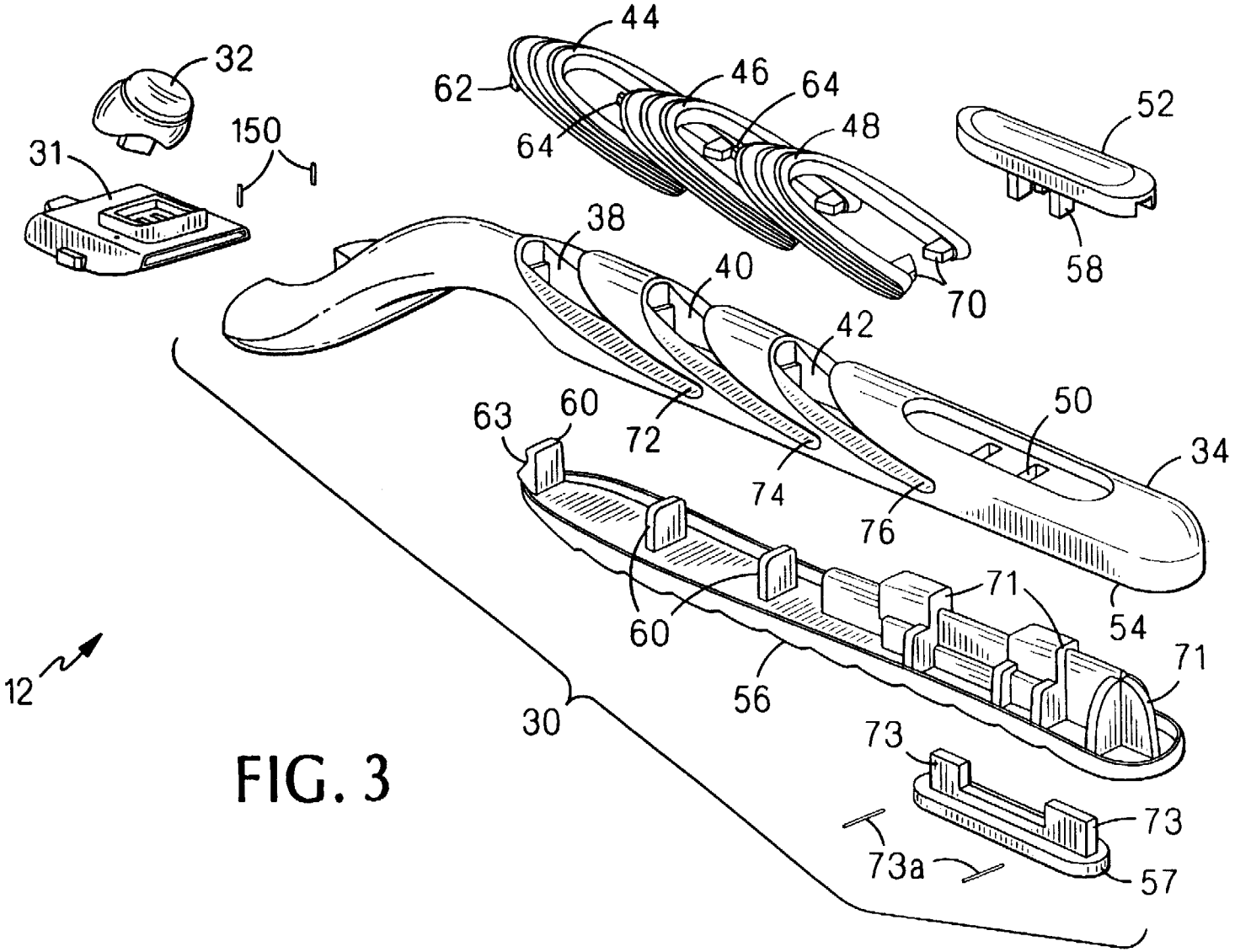
FIG. 3 is an exploded view of the components of the FIG. 2 handle.

Referring to FIGS. 3–7, handle 12 includes elongated hand gripping structure 30 to which cartridge connecting subassembly 31 (described in more detail below) and button 32 are connected. Elongated hand gripping structure 30 includes metal frame 34 as a primary structural member. Cartridge connecting subassembly 31 (FIG. 3) is connected to subassembly connecting end 36 of frame 34. End 36 is generally flat, in order to match the shape of base 27 (FIGS. 1 and 2), and is offset from the rest of frame 34, which is generally straight. The straight portion of frame 34 has three crescent-shaped recesses 38, 40, 42 (see in particular FIGS. 5–6) and associated holes 39, 41, 43 for upper, crescent-shaped gripping pads 44, 46, 48. It also includes oval shaped recess 50 for upper logo panel 52 (FIG. 3) and lower recess 54 (FIG. 7) for lower gripping pad 56, which carries lower logo pad 57 (FIG. 3).

Figure 4A:
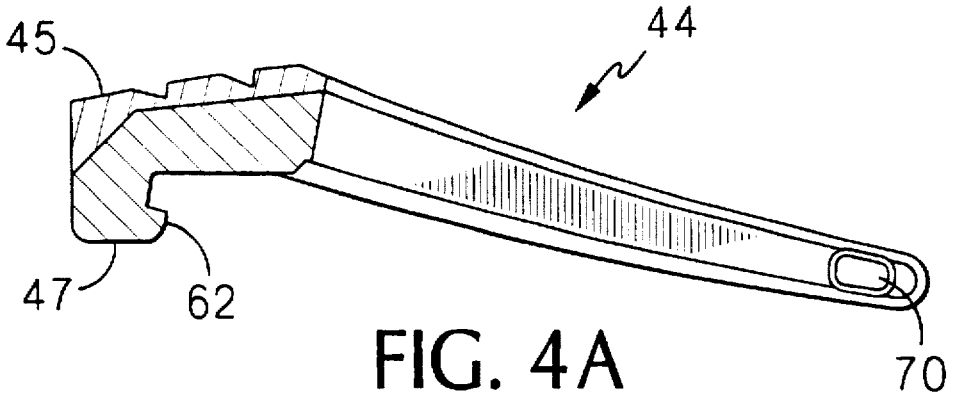
FIGS. 4A and 4B are vertical sectional views of upper gripping pads of the FIG. 2 handle.
Figure 4B:
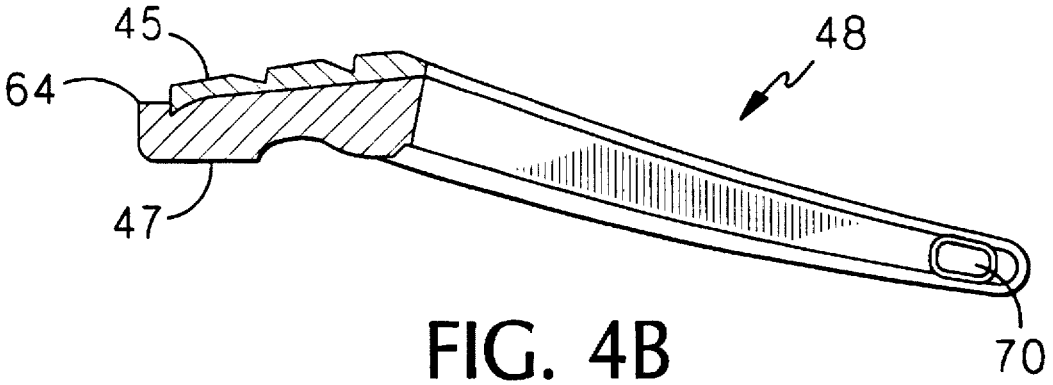

Upper gripping pads 44, 46, 48 and lower gripping pad 56 provide a hand-gripping structure in the completed unit and are each made of an elastomeric plastic outer gripping layer (e.g., thermoplastic elastomer) and a nonelastomeric plastic support layer (e.g., of polypropylene or acrylonitrile butadiene styrene) thereunder made by two-color molding. The two-layer construction of front gripping pad 44 and rear gripping pad 48 (middle gripping pad 46 is similar to pad 48) is shown in FIGS. 4A and 4B, where elastomeric gripping layers 45 and nonelastomeric support layers 47 are shown in the sectional portions.

Figure 8:
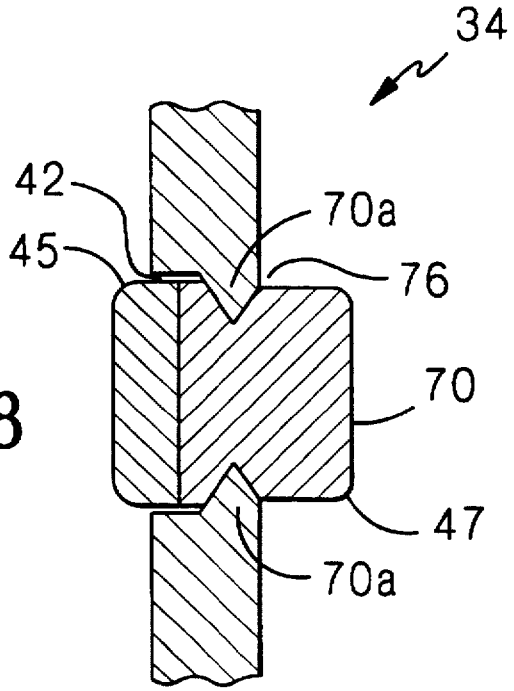
FIG. 8 is a partial vertical sectional view, taken at 8—8 of FIG. 6, showing the connection of locking tabs of the FIGS. 4A and 4B gripping pads to the FIG. 5 frame.
Figure 7:
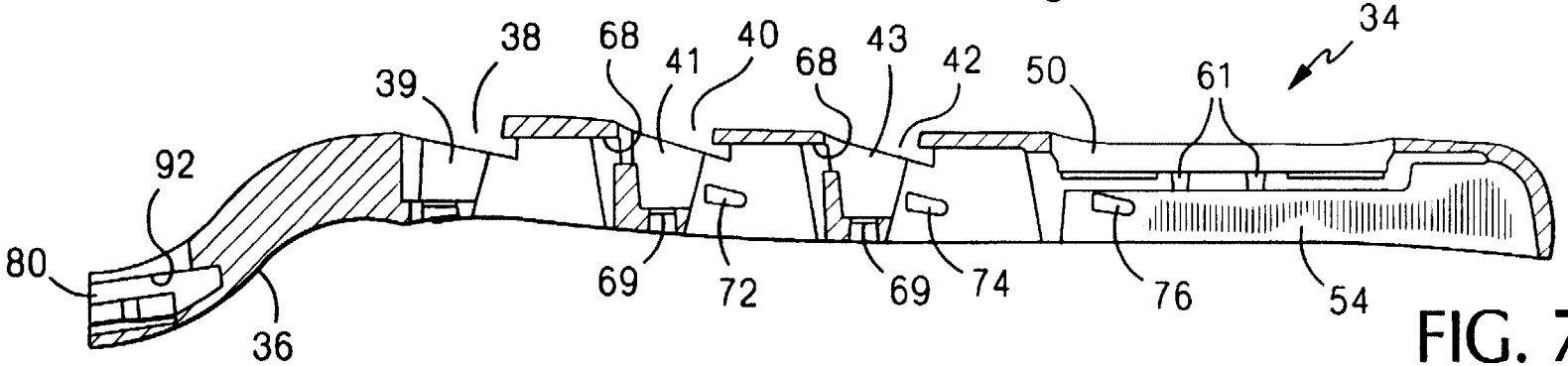
FIG. 7 is a vertical sectional view, taken at 7—7 of FIG. 5, of the FIG. 5 frame.

The nonelastomeric plastic support layer 47 of front gripping pad 44 has rearwardly-directed tab 62 (FIG. 4A) at the front that passes through hole 39 and mates with recess 63 on front extension 60 of lower gripping pad 56 (FIG. 3). Tab 62 is optional, and pad 44 can be securely connected to frame 34 without this feature at the front. The nonelastomeric plastic support layers 47 of middle and rear gripping pads 46, 48 have forwardly-directed tabs 64 (FIG. 4B) at the front that pass through holes 41, 43 and lock under overlying portions 68 of frame 34 (FIG. 7). All upper gripping pads 44, 46, 48 have facing locking tabs 70 that are received in openings 72, 74, 76 of frame 34 (FIGS. 6, 7) at the ends of crescent-shaped recesses 38, 40, 42. Referring to FIG. 8, frame 34 has opposed barbs 70*a* at openings 72, 74, 76, and locking tabs 70 deform as they are inserted past barbs 70*a* into the openings. After insertion, the portions of locking tabs 70 inside of frame 34 (in a region within frame 34 that is larger than the individual openings) return to a size that is larger than the restricted area between barbs 70*a*. Barbs 70*a* inhibit locking tabs 70 from coming out of openings 72, 74, 76 and thus lock tabs 70 and gripping pads 44, 46, 48 in position on frame 34.

Figure 5:
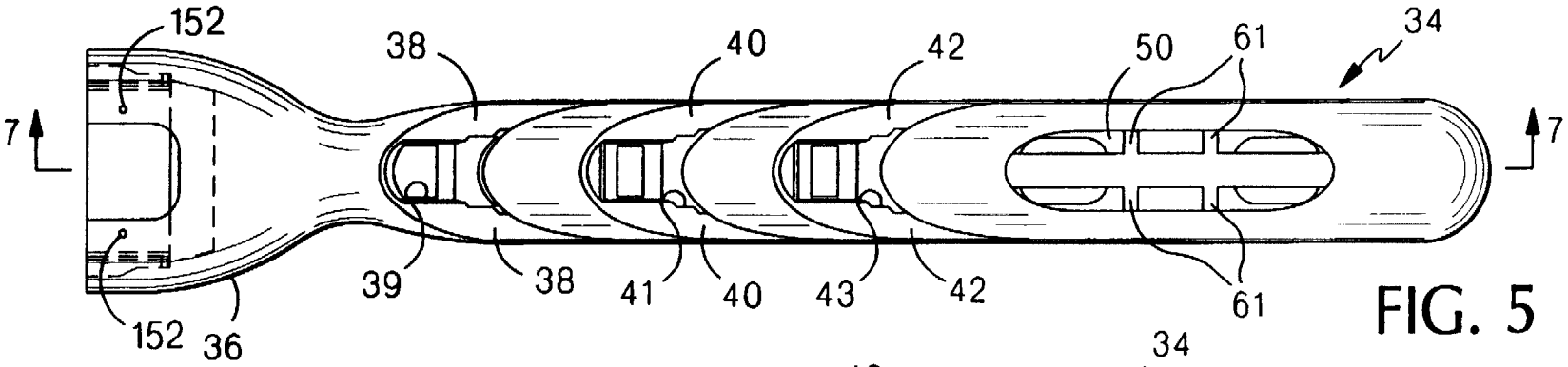
FIG. 5 is a plan view of a frame of the FIG. 2 handle.
Figure 6:
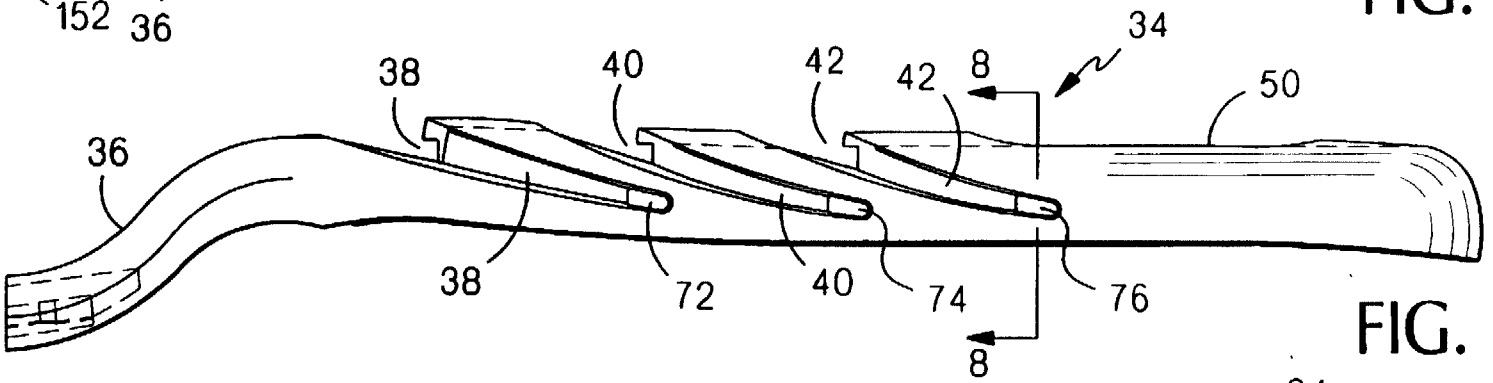
FIG. 6 is an elevation of the FIG. 5 frame.

Upper logo panel 52 has extensions 58 (FIG. 3) that are press-fitted into recesses 61 in frame 34 (FIGS. 5, 7). The nonelastomeric plastic support layer of lower gripping pad 56 has extensions 60 (FIG. 3) that are press-fitted into recesses 69 in frame 34 (FIGS. 5, 7) and extensions 71 that are press-fitted between opposed mating surfaces inside of frame 34. Lower logo panel 57 has extensions 73 that are secured in mating recesses (not shown) in lower gripping pad 56 by staking by pins 73*a*.

Figures 9, 10:
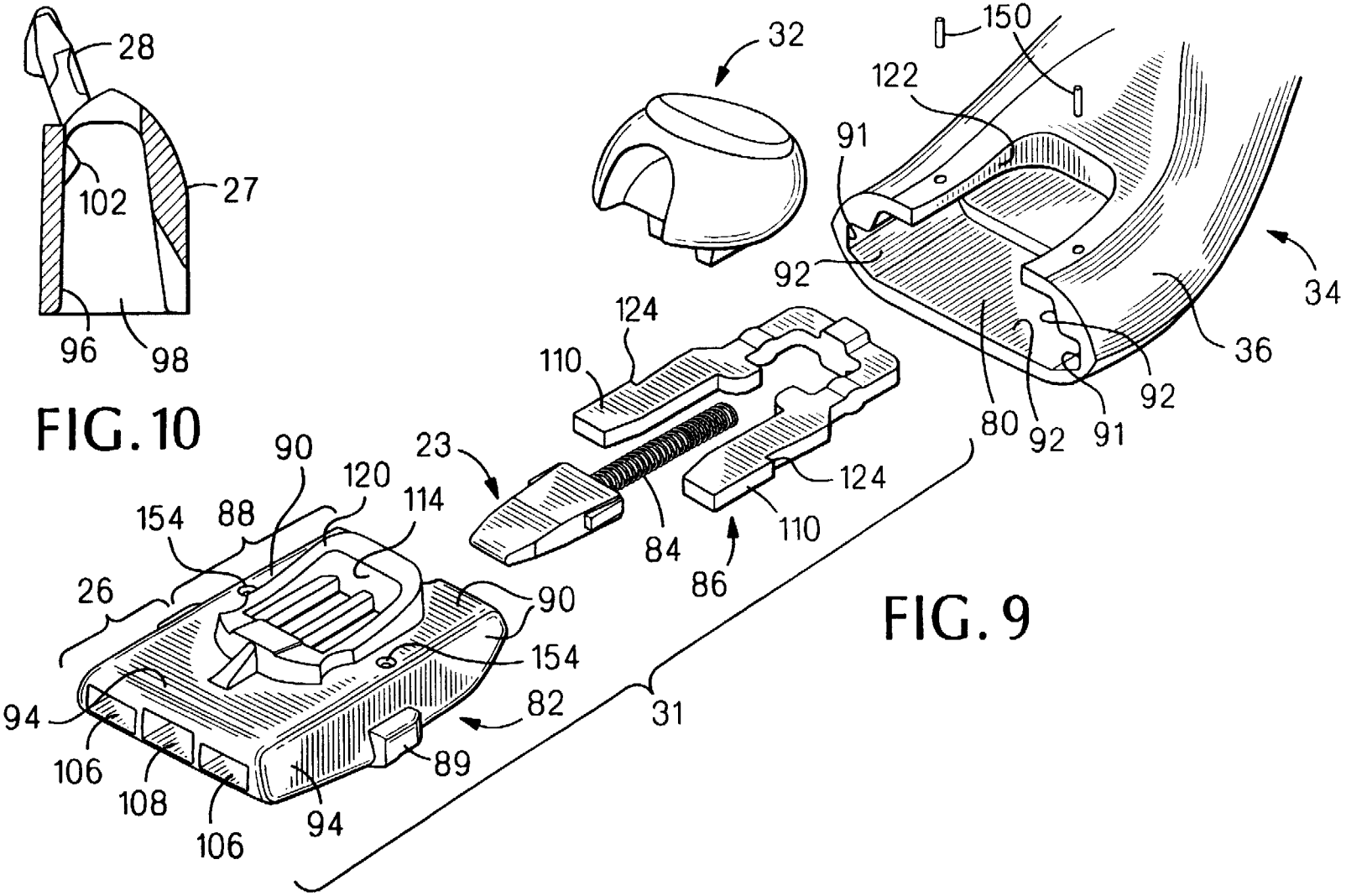
FIG. 9 is an exploded view showing a cartridge connecting subassembly and button at a cartridge connecting end of the FIG. 5 frame of the FIG. 2 handle.
FIG. 10 is a vertical sectional view of a base member of the FIG. 2 cartridge.
Figure 12:
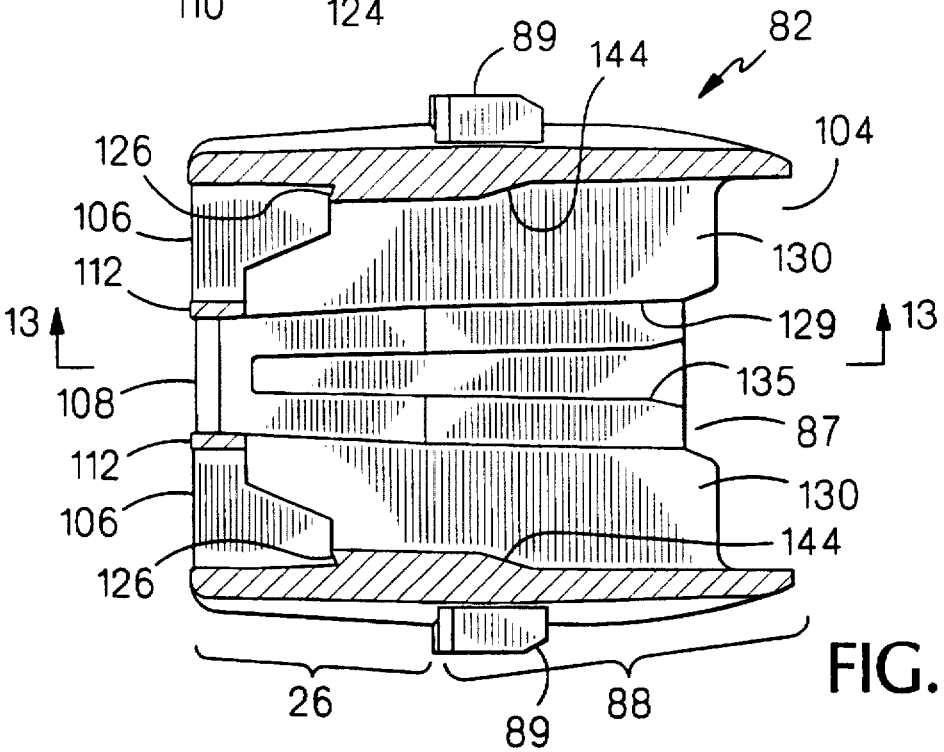
FIG. 12 is a horizontal section of a housing of the FIG. 9 subassembly.

Referring to FIG. 9, the components of cartridge connecting subassembly 31 are shown prior to assembly and prior to mounting of subassembly 31 in recess 80 in subassembly connecting end 36 of frame 34. Subassembly 31 includes housing 82, plunger 23, spring 84, and U-shaped ejector 86. Plunger 23, spring 84, and U-shaped ejector 86 are received in recess 87 (FIGS. 12, 13) in housing 82. Housing 82 includes cartridge connecting structure 26 at the front and handle connecting structure 88 at the rear, as 9, indicated in FIGS. 9 and 12. Handle connecting structure 88 has outer, handle-supporting, surfaces 90 that mate with inwardly directed handle surfaces 92 (FIGS. 7, 9) of frame 34 when mounted in recess 80. Handle connecting structure 88 also has side protrusions 89 for mating with mating recesses 91 of frame 34. Cartridge connecting structure 26 extends from frame 34 when structure 88 is mounted in recess 80 (FIG. 2), and has outer, cartridge-supporting, side surfaces 94 (FIG. 9) that mate with inwardly directed cartridge surfaces 96 of recess 98 of base 27 (FIG. 10). Cartridge connecting structure 26 also includes two depressions 100 (one shown in FIG. 13) that act as cartridge holding structure for releasably holding base 27 via engagement of detents 102 (one shown in FIG. 10) thereon.

Referring to FIGS. 9, 11–15, housing 82 has assembly opening 104 (FIGS. 12, 13) at the rear for receiving the movable components, namely plunger 23, spring 84, and ejector 86, during assembly. At the front of housing 82 are side openings 106 and central opening 108 through which arm portions 110 of ejector 86 and plunger 23 are respectively movable for interaction with cartridge 14. Ribs 112 (FIG. 12) between openings 106, 108 act as blocking structure retaining ejector 86 and plunger 23 on housing 82. Arm portions 110 on each side of plunger 23 are extendible from cartridge connecting structure 26 to eject cartridge 14 from cartridge connecting structure 26.

Figure 11:
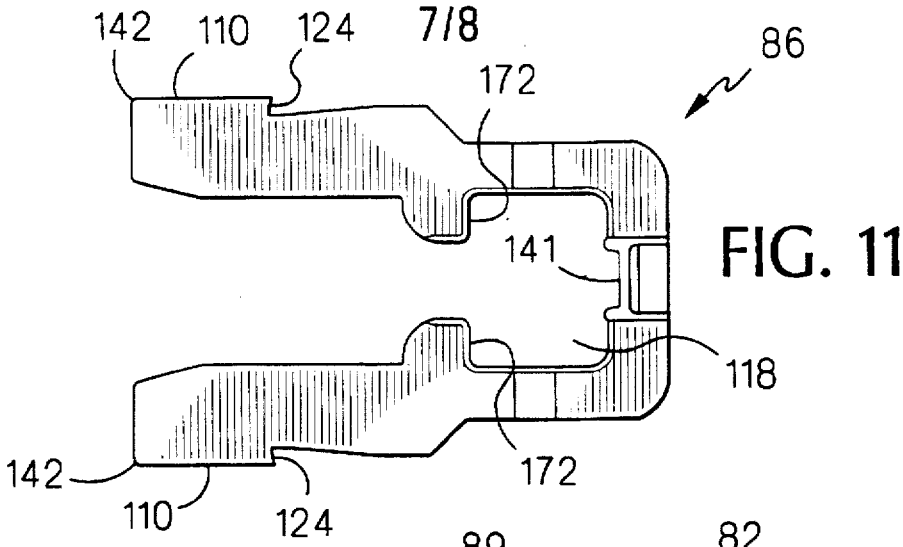
FIG. 11 is a plan view of an ejector of the FIG. 9 subassembly.
Figure 13:
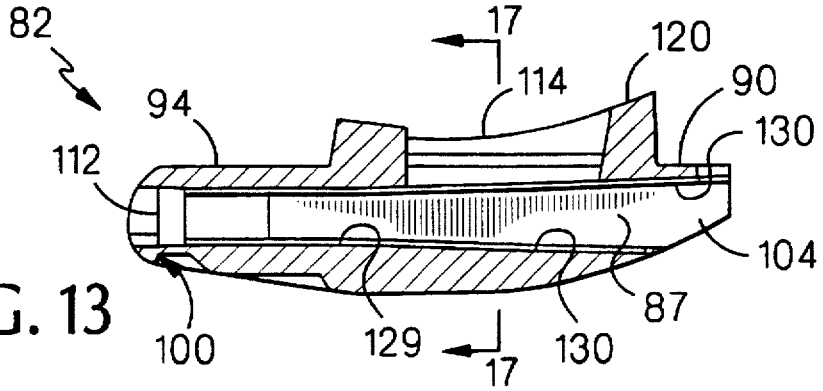
FIG. 13 is a vertical sectional view, taken at 13—13 of FIG. 12, of a housing of the FIG. 9 subassembly.
Figure 14:
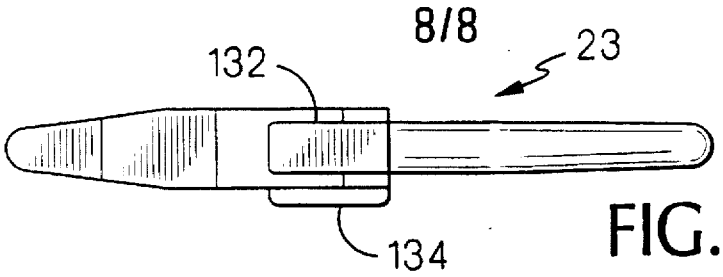
FIG. 14 is an elevation of a plunger of the FIG. 9 subassembly.
Figure 15:
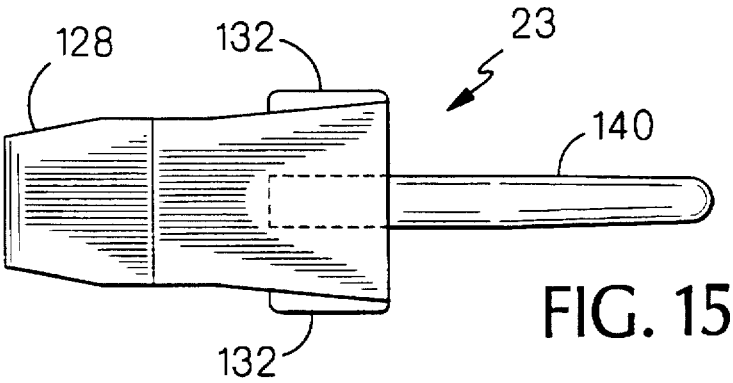
FIG. 15 is an plan view of the FIG. 14 plunger.

Referring to FIGS. 9, 11 and 13, handle connecting structure 88 has opening 114 providing access of bottom extensions 116 of button 32 (FIG. 16) that are received within rectangular region 118 at the back narrow portion of ejector 86 (FIG. 11). Raised lip 120 extends above surface 90 along opening 114. Lip 120 and opening 114 are aligned with and fit within recess 122 of subassembly connecting end 36 of handle 12.

Referring to FIGS. 11, 12, 14, 15, when ejector 86 is mounted in recess 87, angled stop surfaces 124 at arms 110 are biased against and blocked by angled stop surfaces 126 on the inside of recess 87. Ends 110 can be moved forward to extend slightly through openings 106 when the back of ejector 86 is pushed forward by button 32. Plunger 23 is located between arms 110, and front blade 128 extends through opening 108 in front of cartridge connecting structure 26. Blade 128 is thicker than the arms of ejector 86 and slides within track 129, while arms 110 slide in the narrower space between surfaces 130. Side projections 132 of plunger 23 (FIGS. 14, 15) are blocked by ribs 112 and prevented from further forward movement, and bottom projection 134 rides within groove 136 (FIG. 12) to guide plunger 23. Spring 84 is located on shaft 140 and pushes against spring rest 141 at the base of ejector 86. Spring 84 thus performs the dual functions of biasing ejector 86 rearward with surfaces 124 of ejector 86 resting against surfaces 126 of housing 82 and of biasing plunger 23 forward with side projections 132 of plunger 23 resting against ribs 112 of housing 82.

During assembly of cartridge connecting subassembly 31, spring 84 is placed on shaft 140 of plunger 23, and these two components are inserted into recess 87 of housing 82 along track 129. U-shaped ejector 86 is then inserted, with arms 110 straddling plunger 23 in the space between surfaces 130. Front outer corners 142 of arms 110 are deflected inward by cam surfaces 144 of housing 82 during insertion of ejector 86. As angled stop surfaces 124 of arms 110 pass angled stop surfaces 126 of housing 82, arms 110 spring outward, and ejector 86 is retained within housing 82 by blocking of angled stop surfaces 124 by angled stop surfaces 126. All of the movable components of subassembly 31 are thus locked within housing 82 and prevented from falling out during part handling in preparation of assembly on frame 34.

Cartridge connecting subassembly 31 is mounted on frame 34 by inserting handle connecting structure 88 into recess 80 and staking housing 82 to frame 34 using pins 150. Pins 150 pass through holes 152 in frame 34 and aligned holes 154 in the upper surface 90 of handle connecting structure 88 outside of lip 120. The pins are driven into the plastic of housing 82 at lower surfaces 130 outside of the region occupied by narrow portion of U-shaped ejector 86.

Figure 16:
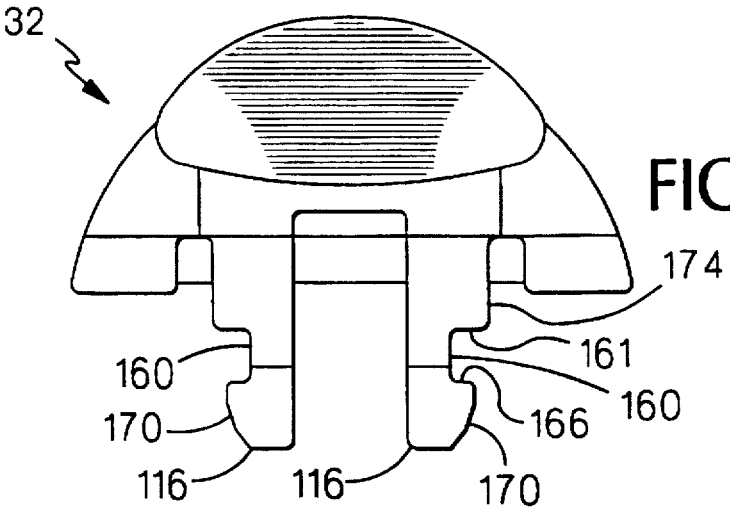
FIG. 16 is an elevation of the button of the FIG. 2 handle.
Figure 17:
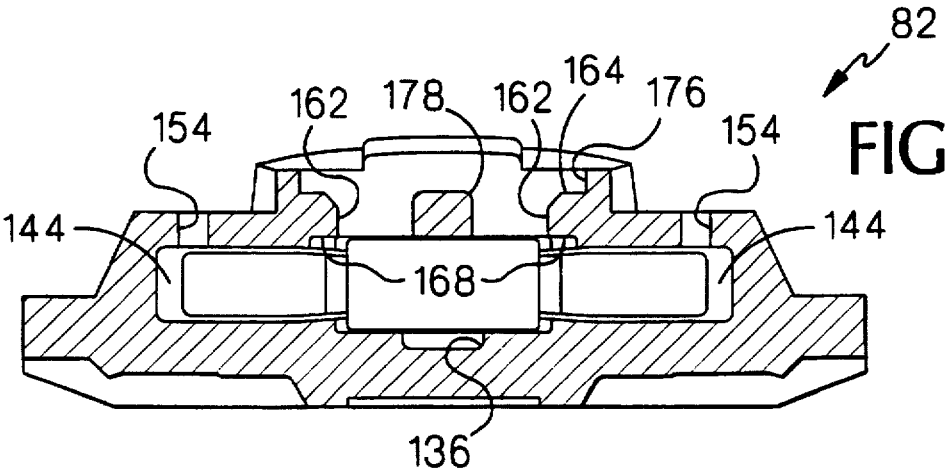
FIG. 17 is a vertical sectional view, taken at 17—17 of FIG. 13, of the housing of the FIG. 9 subassembly.

Button 32 is then inserted into opening 114. Referring to FIGS. 16 and 17, each extension 116 of ejector button 32 has an outwardly directed groove 160 that slides on a respective track 162 within opening 114. The upper surfaces 161 defining grooves 160 slide on the upper surfaces 164 of tracks 162, and the lower surfaces 166 defining groves 160 effect capture on or abut the lower surfaces 168 of tracks 162. Extensions 116 have inclined surfaces 170 that coact with the curved upper corners of tracks 162 to deflect extensions 116 inward as button 32 is inserted into opening 114. When grooves 160 on extensions 116 align with tracks 162, extensions 116 substantially return to their undeflected position and lock ejector button 32 in place within opening 114. The ends of extensions 116 are located within rectangular region 118 and push against surfaces 172 of ejector 86 when ejector button 32 is pushed toward the end of handle 12. After button 32 has been inserted, upper vertical surfaces 174 of extensions 116 sit within the space between upper surfaces 176 of opening 114. Bar 178 serves to capture and guide spring 84.

Button 32 covers openings 154 so that the staking is not visible in the assembled product. Also, after a cartridge 14 has been attached, no part of subassembly 31 is visible (see FIG. 1), and thus the different materials used for housing 82 and frame 34 are not evident.

OTHER EMBODIMENTS

Other embodiments of the invention are within the scope of the appended claims. In place of a trapezoidal extension shape for cartridge connecting structure 26, a six-sided structure, or other asymmetrical shape could be employed.

What is claimed is:

1. A shaving razor handle for connection to a replaceable cartridge comprising an elongated hand gripping structure having a subassembly connecting end with inwardly directed handle surfaces, and a subassembly that is permanently connected to said elongated hand gripping structure comprising a handle connecting structure having outer, handle-supporting side surfaces that mate with said inwardly directed handle surfaces, a cartridge connecting structure having outer, cartridge-supporting side surfaces that mate with inwardly directed cartridge surfaces of a recess on a replaceable cartridge, said cartridge connecting structure including cartridge holding structure for releasably holding said replaceable cartridge, and a movable component within said cartridge connecting structure for interacting with said cartridge when connected to said cartridge connecting structure, said cartridge connecting structure and said handle connecting structure having contiguous portions, whereby said subassembly is substantially covered when said cartridge is connected to said cartridge connecting structure.

2. A shaving razor handle comprising an elongated hand gripping structure having a generally straight portion and a subassembly connecting portion that is offset with respect to said straight portion and is generally flat, and a subassembly that has a generally flat handle connecting structure permanently connected to said subassembly connecting portion, a cartridge connecting structure for making a releasable connection to a replaceable cartridge, and a movable component within said cartridge connecting structure for interacting with said replaceable cartridge when connected to said handle.

3. The handle of claim 1 or 2 wherein said movable component is a spring-biased plunger that has an end that extends from said cartridge connecting structure for biasing said cartridge.

4. The handle of claim 1 or 2, wherein said movable component is an ejector that has a portion that is extendible from said cartridge connecting structure to eject said cartridge from said cartridge connecting structure.

5. The handle of claim 1 or 2, wherein said movable component is a spring-biased plunger that has an end that extends from said cartridge connecting structure for biasing said cartridge, and further comprising a movable U-shaped ejector that is movably mounted on said cartridge connecting structure and has arm portions adjacent each side of said plunger that are extendible from said cartridge connecting structure to eject said cartridge from said cartridge connecting structure.

6. The handle of claim 1 or 2, wherein said movable component is an ejector that has a portion that is extendible from said cartridge connecting structure to eject said cartridge from said cartridge connecting structure, said handle connecting structure has an opening providing access to said ejector, and said elongated hand gripping structure has a recess aligned with said opening, and further comprising a button having a base portion that accesses said ejector through said opening.

7. The handle of claim 1 wherein said movable component is an ejector that has a portion that is extendible from said cartridge connecting structure to eject said cartridge from said cartridge connecting structure, said handle connecting structure has an opening providing access to said ejector, and said elongated hand gripping structure has a recess aligned with said opening, and further comprising a button having a base portion that accesses said ejector through said opening, and wherein said handle connecting structure has a raised lip that extends above said outer, handle-supporting side surfaces along said opening.

8. The handle of claim 7 further comprising a fastener extending from said inwardly directed handle surface to a facing said outer handle-supporting side surface outside of said raised lip, said fastener being covered by said button.

9. The handle of claim 1 wherein said handle connecting structure has side protrusions for mating with mating recesses of said inwardly directed handle surfaces.

10. The handle of claim 1 wherein said cartridge holding structure comprises a depression for mating with a projection on said cartridge.

11. The handle of claim 1 wherein said cartridge holding structure comprises a projection for mating with a depression on said cartridge.

12. A shaving razor handle comprising an elongated hand gripping structure having a subassembly connecting end, a subassembly having a handle connecting structure that mates with said subassembly connecting end, said subassembly including a cartridge connecting structure, an ejector structure that is movably mounted so as to eject a cartridge from said cartridge connecting structure when moved to an ejection position, said ejector structure being U-shaped and having arm portions that are extendible to elect said cartridge from said cartridge connecting structure, a spring that biases said ejector structure away from said cartridge, and a plunger that is movably mounted between said arm portions of said ejector structure and is biased against said cartridge by said spring, and a stake that permanently connects said handle connecting structure to said subassembly connecting end.

13. The handle of claim 12, wherein said handle connecting structure has an opening providing access to said ejector structure, and said elongated hand gripping structure has a recess aligned with said opening, and further comprising a button having a base portion that accesses said ejector structure through said opening, and wherein said stake is adjacent to said recess.

14. The handle of claim 13 wherein said button covers said stake.

15. The handle of claim 13 further comprising an additional stake on the other side of said recess from the first mentioned stake, wherein said button covers said additional stake.

16. A cartridge-connecting subassembly for a shaving razor handle, said subassembly comprising a cartridge connecting structure having outer, cartridge-supporting, side surfaces that mate with inwardly directed cartridge surfaces of a recess on a replaceable cartridge, said cartridge connecting structure including cartridge holding structure for releasably holding a replaceable cartridge, a movable component within said cartridge connecting structure for interacting with said cartridge when connected to said cartridge connecting structure, and a handle connecting structure having outer, handle-supporting, side surfaces that mate with inwardly directed handle surfaces of an elongated hand gripping structure of said razor handle, said cartridge connecting structure and said handle connecting structure having contiguous portions, whereby said subassembly is substantially covered when said handle connecting structure is connected to said elongated hand gripping structure, and said cartridge connecting structure is connected to said cartridge.

17. A cartridge-connecting subassembly for a shaving razor handle, said subassembly comprising a housing, and a movable component within said housing for interacting with a replaceable cartridge when connected to said subassembly, said housing including a handle connecting structure for making a permanent connection to a subassembly connecting end of an elongated hand gripping structure of said razor handle, a cartridge connecting structure for making a releasable connection to said replaceable cartridge, an assembly opening at said handle connecting structure for receiving said movable component during assembly, a cartridge interaction opening at said cartridge connecting structure through which said component is movable for interaction with said cartridge, and blocking structure retaining said movable component in said housing.

18. The subassembly of claim 16 or 17 wherein said movable component is a spring-biased plunger that has an end that extends from said cartridge connecting structure for biasing said cartridge.

19. The subassembly of claim 16 or 17 wherein said movable component is an ejector that has a portion that is extendible from said cartridge connecting structure to eject said cartridge from said cartridge connecting structure.

20. The subassembly of claim 16 or 17 wherein said movable component is a spring-biased plunger that has an end that extends from said cartridge connecting structure for biasing said cartridge, and further comprising a movable U-shaped ejector that is movably mounted in said cartridge connecting structure and has arm portions adjacent each side of said plunger that are extendible from said cartridge connecting structure to eject said cartridge from said cartridge connecting structure.

21. The subassembly of claim 16 wherein said movable component is an ejector that has a portion that is extendible from said cartridge connecting structure to eject said cartridge from said cartridge connecting structure, said handle connecting structure has an opening providing access of a base portion of a button to said ejector, and said elongated hand gripping structure has a recess aligned with said opening.

22. The subassembly of claim 21 wherein said handle connecting structure has a raised lip that extends above said outer, handle-supporting side surfaces.

23. The subassembly of claim 22 wherein said handle connecting structure has fastener holes through said outer handle-supporting side surfaces outside of said raised lip for receiving a fastener to said elongated hand gripping structure.

24. The subassembly of claim 16 wherein said handle connecting structure has side protrusions for mating with mating recesses of said inwardly directed handle surfaces.

25. The subassembly of claim 16 wherein said handle connecting structure has an assembly opening for receiving said movable component during assembly, said cartridge connecting structure has a cartridge interaction opening through which said component is movable for interaction with said cartridge, and further comprising blocking structure retaining said movable component in said subassembly.

26. The subassembly of claim 16 wherein said holding structure comprises a depression for mating with a projection on said cartridge.

27. The subassembly of claim 16 wherein said holding structure comprises a projection for mating with a depression on said cartridge.

28. The subassembly of claim 17 wherein said movable component has a first cam surface and a first stop surface, and wherein said housing has a second cam surface against which said first cam surface is deflected during insertion through said assembly opening, and wherein said blocking structure has a second stop surface against which said first stop surface is blocked after passing said second cam surface and returning to an undeflected position, said movable component being prevented from returning through said assembly opening by interaction of said first and second stop surfaces.

29. The subassembly of claim 17 wherein said blocking structure comprises ribs across said interaction opening permitting passage of one part of said movable component therethrough and blocking another part of said movable component.

30. A cartridge-connecting subassembly for a shaving razor handle, said subassembly comprising a housing having handle connecting structure for making a permanent connection to a subassembly connecting end of an elongated hand gripping structure of said razor handle, said housing having a cartridge connecting structure for making a releasable connection to a replaceable cartridge, an ejector structure that is separate from said cart ridge connecting structure and is movably mounted in said housing with respect to said cartridge connecting structure so as to eject said cartridge from said cartridge connecting structure when moved to an ejection position, said elector structure being U-shaped and having arm portions that are extendible from said cartridge connecting structure to elect said cartridge from said cartridge connecting structure, a spring within said housing that biases said ejector structure away from said cartridge, and a plunger that is movably mounted in said cartridge connecting structure between said arm portions of said ejector structure, extends from said cartridge connecting structure for biasing said cartridge and is biased toward said cartridge by said spring.

31. The subassembly of claim 30 wherein said handle connecting structure has an opening providing access of a base portion of a button to said ejector structure, and said elongated hand gripping structure has a recess aligned with said opening.

32. The subassembly of claim 31 wherein said handle connecting structure has outer, handle-supporting, side surfaces that mate with inwardly directed handle surfaces of said elongated hand gripping structure of said razor handle, and said handle connecting structure has a raised lip that extends above said outer, handle-supporting side surfaces along said opening.

33. A method of manufacturing a shaving razor handle comprising providing a cartridge-connecting subassembly comprising a cartridge connecting structure having outer, cartridge-supporting, side surfaces that mate with inwardly directed cartridge surfaces of a recess on a replaceable cartridge, said cartridge connecting structure including cartridge holding structure for releasably holding said replaceable cartridge, a movable component within said cartridge connecting structure for interacting with said cartridge when connected to said cartridge connecting structure, and a handle connecting structure having outer, handle-supporting, side surfaces, said cartridge connecting structure and said handle connecting structure having contiguous portions, providing an elongated hand gripping structure having inwardly directed handle surfaces that mate with said outer, handle-supporting, side surfaces of said handle connecting structure, and securing said handle connecting structure to said elongated hand gripping structure, said inwardly directed handle surfaces mating with said outer, handle-supporting, side surfaces, whereby said subassembly is substantially covered when said cartridge connecting structure is connected to said cartridge.

34. A method of manufacturing a shaving razor handle comprising providing a cartridge-connecting subassembly comprising a housing, and a movable component within said housing for interacting with a replaceable cartridge when connected to said subassembly, said housing including a handle connecting structure, a cartridge connecting structure for making a releasable connection to said replaceable cartridge, an assembly opening at said handle connecting structure for receiving said movable component during assembly, a cartridge interaction opening at said cartridge connecting structure through which said component is movable for interaction with said cartridge, and blocking structure retaining said movable component on said housing, and securing said subassembly to a subassembly connecting end of an elongated hand gripping structure of said razor handle, said assembly opening being covered by said subassembly connecting end after said securing.

35. The method of claim 33 or 34 wherein said movable component is an ejector that has a portion that is extendible from said cartridge connecting structure to eject said cartridge from said cartridge connecting structure, and said handle connecting structure has an access opening providing access of a base portion of a button to said ejector, and further comprising inserting said base portion into said access opening so as to interact with said ejector.

36. The method of claim 33 or 34 wherein said handle connecting structure has a fastener hole, and wherein said securing includes placing a fastener to said elongated hand gripping structure in said fastener hole.

37. A method of assembling a cartridge connecting subassembly for a shaving razor handle, said method comprising providing a housing having a handle connecting structure for making a permanent connection to a subassembly connecting end of an elongated hand gripping structure of said razor handle, a cartridge connecting structure for making a releasable connection to a replaceable cartridge, an assembly opening at said handle connecting structure, a cartridge interaction opening and blocking structure at said cartridge connecting structure, and inserting a movable component into said housing through said assembly opening, said component being movable through said interaction opening for interaction with said cartridge when connected to said subassembly, said blocking structure retaining said movable component in said housing.

38. The method of claim 37 wherein said inserting said movable component includes inserting a spring-biased plunger that has an end that extends from said cartridge connecting structure for biasing said cartridge.

39. The method of claim 36 wherein said inserting said movable component includes inserting an ejector that has a portion that is extendible from said cartridge connecting structure to eject said cartridge from said cartridge connecting structure.

40. The method of claim 36 wherein said movable component is a spring-biased plunger that has an end that extends from said cartridge connecting structure for biasing said cartridge, and further comprising inserting a movable U-shaped ejector that is movably mounted in said cartridge connecting structure and has arm portions adjacent each side of said plunger that are extendible from said cartridge connecting structure to eject said cartridge from said cartridge connecting structure.

41. The method of claim 36 wherein said movable component has a first cam surface and a first stop surface, and wherein said housing has a second cam surface, and wherein said first cam surface is deflected during said insertion through said assembly opening by said second cam surface, and wherein said blocking structure has a second stop surface against which said first stop surface is blocked after passing said second cam surface and returning to an undeflected position, said movable member being prevented from returning through said assembly opening by interaction of said first and second stop surfaces.

* * * * *